US005134730A

United States Patent [19]

Vandis

[11] Patent Number: 5,134,730

[45] Date of Patent: Aug. 4, 1992

[54] POOL DECK PROTECTIVE LINER

[76] Inventor: Nancy H. Vandis, 4730 Laurel Grove Ave., N. Hollywood, Calif. 91607

[21] Appl. No.: 545,815

[22] Filed: Aug. 6, 1990

[51] Int. Cl.[5] ..... E04H 4/00

[52] U.S. Cl. ..... 4/504; 4/503; 4/506; 4/496

[58] Field of Search ..... 4/496, 504, 494, 499, 4/503, 506

[56] References Cited

U.S. PATENT DOCUMENTS

| | | | |
|---|---|---|---|
| 3,077,610 | 2/1963 | Gazdik | 4/503 |
| 3,271,787 | 9/1966 | Clary | 4/504 |
| 3,351,958 | 11/1967 | Shields | 4/496 |
| 3,509,585 | 5/1970 | Solomon | 4/503 |
| 3,667,071 | 6/1972 | Hoch et al. | 4/506 |
| 3,747,131 | 7/1973 | Koliomichalis | 4/503 |
| 3,778,804 | 12/1973 | Adair | 4/496 |
| 4,094,021 | 6/1978 | Rapp | 4/503 |
| 4,139,117 | 2/1979 | Dial | 4/499 |
| 4,879,772 | 11/1989 | Meloney, Jr. | 4/506 |

*Primary Examiner*—Ernest G. Cusick
*Assistant Examiner*—Keith Kupferschmid

[57] ABSTRACT

A pool deck protective liner in the nature of a pool guard for swimmers is provided to extend around the deck of a swimming pool adjacent the edge of the deck at the swimming pool and along edges of structural components of the pool such as step ladders, diving boards and the like. The protective liner is comprised of a plurality of inflatable tubes which are sized and shaped to extend around the edges of the swimming pool deck and structural components thereof. Moreover, the individual tubes are endwise abuttable to form a generally peripherally extending liner. A member is provided on the inflatable tubes to hold the endwise abutted inflatable tubes along the edge of the swimming pool deck. It is also possible to provide a long length of rolled inflatable tube which a user can cut to select lengths and secure to the edge of a deck of a swimming pool surrounding a swimming pool itself.

5 Claims, 2 Drawing Sheets

POOL DECK PROTECTIVE LINER

BACKGROUND OF THE INVENTION

1. Field of the Invention

This invention relates in general to certain new and useful pool deck protective liners, and more particularly to an inflatable protective liner which extends around the edge of a pool deck adjacent a swimming pool.

2. Brief Description of the Prior Art

It is well known that children and even adults oftentimes scrape parts of their body when engaging the edge of a pool deck. Oftentimes, and particularly, children will attempt to climb out of a swimming pool using the edge of the deck for support. In so doing, it is common place for these children to scratch and abrade arms and legs and the like.

While the scratches and abrasions which may result from engagement of a pool deck at the edge thereof are not usually of a serious nature, there have been many occasions in which children and even adults will accidentally knock a portion of their body into the edge of the pool deck. Chipping of a tooth and head injuries oftentimes can result from any inadvertence in attempting to climb out of a swimming pool or merely playing in the swimming pool adjacent the edge thereof at the deck.

The above and other injuries could easily be avoided by the provision of some form of protective liner which extends around the periphery of the swimming pool deck at the edge thereof and around the structural components such as ladders and diving boards. However, heretofore, there has not been any effective swimming pool deck liner which is relatively low in cost but which is highly effective in precluding injuries which are often occasioned at the edge of a swimming pool deck.

OBJECTS OF THE INVENTION

It is, therefore, one of the primary objects of the present invention to provide a swimming pool deck liner which extends around the periphery of a swimming pool deck.

It is also an object of the present invention to provide a swimming pool liner which is capable of extending around the periphery of a diving board or the steps or rails of a ladder or other structural component forming part of a swimming pool construction.

It is another object of the present invention to provide a swimming pool deck liner of the type stated which is comprised of a plurality of endwise abuttable and inflatable tubes.

It is a further object of the present invention to provide a swimming pool protective deck liner of the type stated in which each of the inflatable and endwise abuttable tubes are provided with a valve means for purposes of inflating and deflating the tubes.

It is still another object of the present invention to provide a swimming pool protective deck liner of the type stated which is provided with a holding means for securing the tubes in their endwise abutted relationship around the edge of the swimming pool deck.

It is still a further object of the present invention to provide a swimming pool deck protective liner of the type stated which can be constructed at a relatively low cost and which is thereby easily affordable but which also is highly effective in use.

With the above and other objects in view, my invention resides in the novel features of form, construction, arrangement and combination of parts presently described and pointed out in the claims.

BRIEF SUMMARY OF THE INVENTION

A pool deck protective liner to extend around the deck of a swimming pool adjacent the edge of the deck at the swimming pool. The protective liner comprises a plurality of inflatable tubes which are capable of being inflated.

The liner of the present invention has been identified as a pool deck protective liner due to the fact that its greatest utility may well lie in protecting against injuries at the edge of a swimming pool deck However, the liner is not so limited and is capable of being used around other structural components of the swimming pool, as for example, on swimming pool ladders including both the steps and the rails of the ladders, and diving boards. Thus, the term "pool deck" is used in a generic sense to include all structural components of that pool deck including the ladder and the diving board.

Each of the inflatable tubes is preferably inflated by air or other gas for purposes of convenience and ease of filling and also to provide a great degree of resiliency in the event that a user engages the tube with a relatively large amount of force or with any significant velocity which would otherwise result in severe injury. However, it should be understood that various fluids may be used for filling of the individual tubes Thus, liquids such as water and the like can also be used as the tube filling medium. Further, small particulate matter which are capable of moving in the nature of liquids can also be employed as the tube filling medium. Thus, gases, liquid and particulate matter are encompassed by the term "fluid". In like manner, the term "inflate" is used in a broad sense to mean a filling of the tubes, whether with gas, liquid or solid particulate matter.

Each of the individual inflatable tubes has a length which is less than the overall length or the overall width of any edge of a swimming pool. Thus, relatively short tube sections are desirable for purposes of transport and storage while in the inflated condition. However, each of the individual tubes is adapted for endwise abutting engagement to extend fully around or otherwise around a substantial portion of the edge of the deck of a swimming pool.

Each of the inflatable tubes is preferably provided with valve means in which to inflate the tube or to deflate the tube. Further, means is connected to each of the tubes to hold the tubes in their endwise abutted position around the portion of the periphery of the swimming pool deck.

The tubes also have a configuration so as to extend around and engage an edge portion of the upper surface of the deck and a vertically disposed edge portion of the deck. In this way, the tubes are generally form-fitted around the edge of the deck. They will also provide protection against and preclude hard contact of the user against the edge of a swimming pool deck.

In a more preferred embodiment of the present invention, each of the tubes has an upper lip section which extends around a corner of the edge of the deck and a lower section which extends downwardly over vertically disposed section of the deck.

The means for holding the plurality of tubes in their endwise abutted relationship may comprise a web attached to the tubes with a chamber having a heavy particulate matter therein and which chamber is connected to the web in order to hold the tube on the deck. In another embodiment of the invention, the means for holding the tubes could comprise Velcro strips on the tubes for engaging a deck surface or otherwise for engaging a similar Velcro strip on the upper surface of the pool deck. In this latter embodiment, one Velcro strip would be secured to each tube as for example, by adhesive attachment and a mating Velcro strip would be secured to the upper surface of the pool deck also by an adhesive attachment.

In another embodiment of the invention, it is possible to provide the pool deck protective liner in an uncut roll of elongate tube. In this way, the user of the pool deck protective liner can cut the liner to the desired length and seal the edges thereof, oftentimes by any convenient source of heat, such as a steam iron or the like. In this way, inflatable tubes can easily be formed by the user.

This invention has many other purposes and has other advantages which will be made more fully apparent from a consideration of the forms in which it may be embodied. One of these forms of the unique and novel deck protective liner is disclosed in the following detailed description of the invention. However, it should be understood that this detailed description is set forth only for purposes of illustrating the general principles of the invention but is not to be taken in a limiting sense.

BRIEF DESCRIPTION OF THE DRAWINGS

Figure 1:
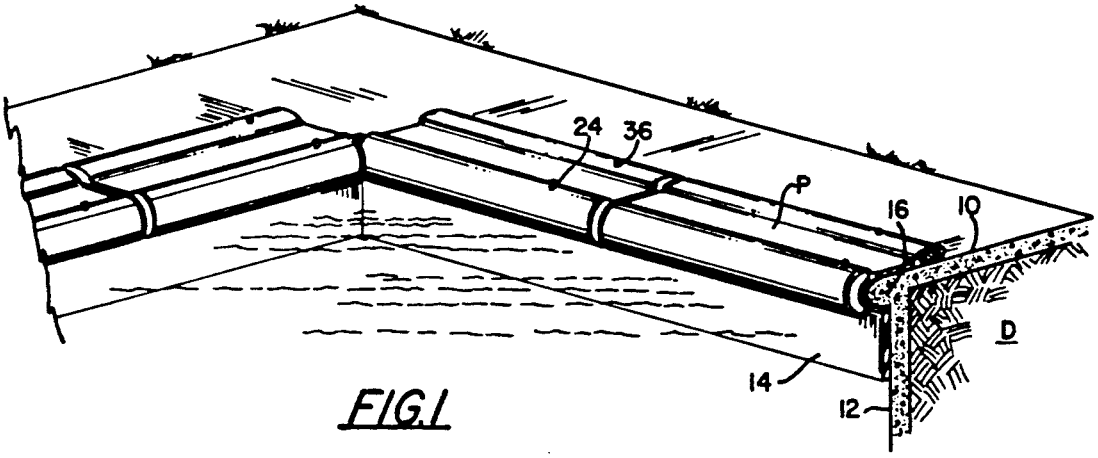
Figure 2:
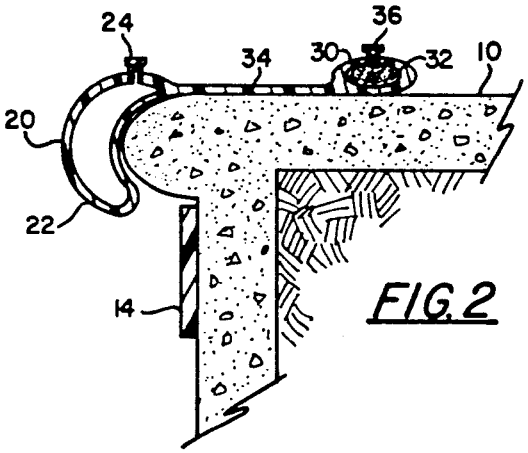
Figure 3:
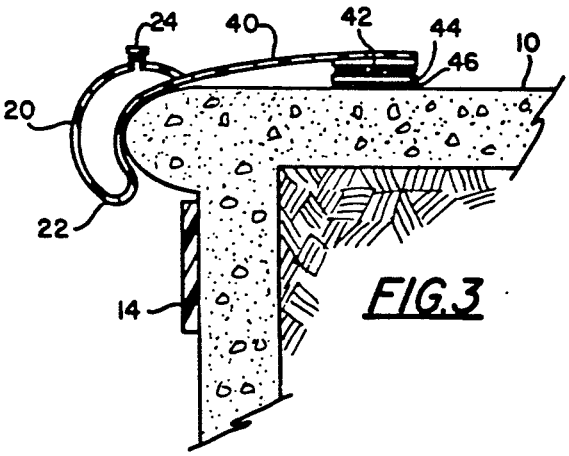
Figure 4:
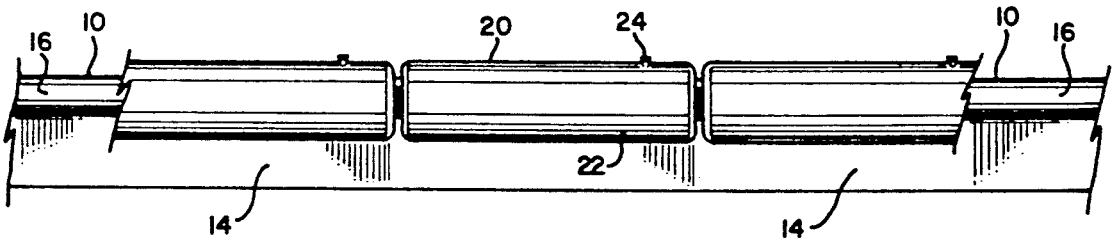
Figure 5:
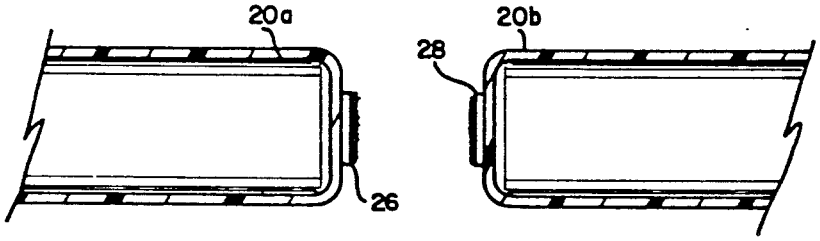

Having thus described the invention in general terms, reference will now be made to the accompanying drawings in which:

FIG. 1 is a fragmentary view broken away and showing the use of one embodiment of the pool deck protective liner in connection with the edge of a pool deck;

FIG. 2 is a vertical sectional view showing the pool deck protective liner adjacent the edge of a deck of a swimming pool;

FIG. 3 is a vertical sectional view, somewhat similar to FIG. 2 and showing an alternate means of holding the pool deck protective liner adjacent the edge of a swimming pool;

FIG. 4 is a fragmentary elevational view showing a plurality of pool deck protective liners in endwise abutted engagement around the deck of a swimming pool; and FIG. 5 is a fragmentary vertical sectional view showing a means for attaching a pair of endwise abuttable protective liner sections.

DETAILED DESCRIPTION OF A PREFERRED EMBODIMENTS

Referring now in more detail and by reference characters to the drawings which illustrate a preferred embodiment of the present invention, D designates the deck of a swimming pool having an upper deck surface 10 and a vertically disposed pool wall 12. Many conventional swimming pools are provided with an upper section of decorative tile 14 adjacent the upper edge thereof.

Many swimming pools are provided with a vertically disposed wall which merges into a horizontal deck at a sharp corner. However, in a more preferred construction, many swimming pools are provided with a somewhat rounded bead-like corner 16.

A pool deck protective liner P of the present invention is shown in one embodiment in FIGS. 1 and 2. In this case, the pool deck protective liner P is comprised of a plurality of individual endwise abutted tubes 20 as shown in FIG. 4. Each of these tubes have a hollow interior chamber 22 capable of being filled with air or other suitable gas by means of an openable and closable inlet valve 24. However, as indicated above, other tube filling mediums may be employed and include for example liquids and finely divided solid particulate matter. Valves of these types are conventional and typically are found in air-framed waterbeds.

In the embodiment as illustrated in FIG. 4, each of the individual tubes 20 are endwise abutted against one another. Moreover, each of the tubes 20 have a length which is less than the overall length or overall width of any edge of the swimming pool. In this way, they are conveniently adapted for storage and transport in small packages. Further, a large number of the individual tubes could be packaged in a single light-weight container for transport or storage.

The individual tubes 20 may be connected together at their ends by means of Velcro strips. FIG. 5 illustrates an embodiment where one protective tube **20*a* is provided with a Velcro strip 26 containing hook-like fiber fasteners 26. Another protective tube 20*b* is provided with a Velcro strip 28** containing loop-type fiber fasteners forming part of the Velcro arrangement. In this way, individual tubes may be endwise abutted against each other and held in position by means of the Velcro strips.

Each of the tubes 20 is also held adjacent the edge of the swimming pool deck, in the embodiment as illustrated in FIGS. 1 and 2, by means of weighted cylindrical tubes 30. In this case, each of the cylindrical tubes 30 is provided with a particulate matter such as sand 32 on the inner surface thereof. These holding cylinders or tubes 30 merely lay against the upper surface of the deck of the swimming pools and are retentively held by their weight. In addition, each of the tubes 22 is connected to the holding cylinders by means of a flexible plastic web 34.

In accordance with this construction, the user of the pool deck protective liner may position a plurality of endwise abutted tubes adjacent the edge of the deck of a swimming pool. Each of the tubes 20 may then be inflated through the inlet valves 24. In addition, sand or other particulate matter of substantial weight is then introduced into the cylinders 30. For this purpose, each of the cylinders 30 may be provided with an upper opening plug 36 which may be removed for purposes of introducing the sand or the particulate matter into the holding cylinders.

FIG. 3 illustrates an embodiment of the invention which utilizes an alternate form of securing the pool deck protective liner to the deck of the swimming pool. In this embodiment, each of the individual inflatable tubes 22 is provided with a web 40 which is, in turn, provided with a Velcro strip 42 at its outer end. This Velcro strip 42 is adapted to engage a mating Velcro strip 44, the latter of which may be attached to the upper surface of the deck of the swimming pool by any suitable means. In the embodiment as illustrated in FIG. 3, the mating Velcro strip 44 is secured to the deck upper surface 10 by means of an adhesive layer 46. However, the Velcro strip 44 could be secured to the upper deck surface by means of implanting the same in the concrete deck, or otherwise securing the same to wooden strips which are, in turn, nailed to the concrete deck or the like. In effect, any means for holding the mating Velcro strip 44 on the deck may be employed.

It should also be understood that other forms of releasably attaching the strip 42 to the strip 44 may be employed and need not be in the form of Velcro-type strips. Thus, strips having adhesive layers may also be employed for releasably attaching the strip 44 to the strip 42. Other means for securing the pool deck protective liner to the surface of a swimming pool deck or other components thereof may be employed. For this purpose, the so-called "Pop-it" pearls may be employed. These Pop-it pearls generally comprise a system of beads with each having prong-like projection capable of extending into a prong receiving recess on an adjacent bead. Other means for attachment include tracks which are secured to the pool deck and have recesses to receive runners on the underside of the individual tubes. These runners and for that matter, the tracks themselves may also be formed of extrudable plastics.

In a preferred embodiment, the individual inflatable tubes 20 are each C-shaped and are about six feet long. However, the length could vary in order to achieve a desired length of convenience for both use and packaging. Moreover, the Velcro strips or other holding cylinders 30 are sufficiently narrow and they do not interfere with or provide any obstruction to the use of the pool. Nevertheless, they do provide a sufficient gripping surface for individuals who prefer the safety of hanging onto the edge of a swimming pool.

The individual lengths of tubes are also short enough and flexible enough to allow a swimming pool owner to shape multiple tubes around the swimming pool to conform to the shape of swimming pools which may be other than rectangular. In addition, the individual lengths are sufficiently small so as to permit elimination of many of the problems of locating around steps, ladders and diving boards.

The individual tubes are normally provided in predetermined dimensions, as aforesaid, and for purposes of storage and/or transport, can be rolled up and packaged in individual containers. However, in another embodiment of the invention, the inflatable pool deck protective liner could be provided in a much longer length. In this way, the user of the pool can cut the tube to an exact dimension for his or her pool. The cut tubes could then be sealed at their opposite transverse ends by heat or glue by the pool owner. For this purpose, many of the plastics could be provided so that they are heat sealable through the heat of a conventional steam iron or the like. In like manner, many conventional glues can also be provided along with the length of uncut inflatable tube in order to enable the user to easily and conveniently seal the cut edges of the tubes.

The bottom of the inflatable tubes may also be slightly abraded or formed of an abrasive material so as to frictionally engage the upper surface of the swimming pool deck. In like manner, the upper surface of the inflatable tubes could also be slightly abraded or formed of an abrasive material to enable a user of the swimming pool to hold on to the pool deck protective liner.

In still other embodiments of the present invention, the individual tubes could be provided with straps secured thereto for purposes of being engaged by the hands of a user. In like manner, the tubes could be formed with hand-held recesses so as to enable a user to hold onto the side of the pool deck protective liner.

The individual tubes could easily be inflated, when using air, by hand or foot operated pumps. In like manner, vacuum cleaners and possibly even garden leaf blowers could be used for filling of the individual tubes.

The various tubes which are used in the pool deck protective liner are preferably formed of a plastic material such as polyethylene or polypropylene. Further, some rubber should be incorporated into the plastic in order to enable flexibility so that the tubes can be blown and shaped to a proper size. Further, the tubes could be formed by any of a number of conventional plastic molding techniques. Thus, for example, the tubes could be formed through molding or extrusion. The tubes themselves could also have an abraded or rougher surface, as indicated, in order to enable engagement by the hands of a user. Thus, it may be desirable to use a surface abraded tube due to the fact that a wet tube may be difficult to engage and to immediately grasp. In like manner, a cloth or cloth-like surface can be included on the exterior of the tube in order to add to the aesthetics, and also to preclude heat build up in the tube.

Thus, there has been illustrated and described a unique and novel pool deck protective liner for extending around the edge of a swimming pool and on structural components of a pool deck to protect the user of the swimming pool and which is relatively inexpensive and easy to install. The present invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention.

Having thus described the invention, what I desire to claim and secure by letters patent is:

1. A portable and inflatable pool deck protective liner adapted to extend around the deck of a swimming pool adjacent the edge of the deck at the swimming pool for protecting swimmers from a hard contact against an edge of a swimming pool and which edge is formed as a corner between a vertically disposed surface and a horizontally disposed upper surface, said protective liner comprising;

a) a plurality of inflatable tubes capable of being inflated with a fluid and which are adapted for endwise abutting engagement with one another to extend around a portion of the edge of the deck of a swimming pool, b) valve means on each of said tubes to inflate the tubes with a fluid and to deflate the tubes, c) means connected to each of said tubes to hold said tubes in endwise abutted position with one another around the edge of the deck of the swimming pool with each of said tubes when inflated having a portion thereof wrapping around the edge of the deck and engaging the upper horizontally disposed surface of the deck and with portions thereof when wrapped around the edge of the deck engaging the vertically disposed surface of the deck, such that the edge of a swimming pool and the vertically disposed surface and horizontally disposed surface which meet at the edge are covered by such resilient tubes to absorb the force of an impact by a swimmer and to thereby provide protection to a swimmer against and preclude hard contact of swimmer against the edge of the pool deck.

2. The pool deck protective liner of claim 1 further characterized in that said means for holding comprises a web attached to said tubes and having a chamber having particulate matter connected to said web to thereby hold the tubes to the deck.

3. The pool deck protective liner of claim 2 further characterized in that the particulate matter is sand.

4. The pool deck protective liner of claim 1 further characterized in that said means for holding comprises Velcro strips on the tubes for engaging a deck surface or a similar Velcro strip on the upper surface of a pool deck.

5. The pool deck protective liner of claim 4 further characterized in that at least one Velcro strip is adhesively secured to said pool deck and a mating Velcro strip is secured to each of said tubes.

* * * * *